US012687345B2

(12) United States Patent
Chiou

(10) Patent No.: US 12,687,345 B2
(45) Date of Patent: Jul. 21, 2026

(54) LOOP HEAT PIPE WITH BARRIER BODY IN CONDENSATION SECTION

(71) Applicant: ASUSTeK COMPUTER INC., Taipei City (TW)

(72) Inventor: Ing-Jer Chiou, Taipei City (TW)

(73) Assignee: ASUSTeK COMPUTER INC., Taipei City (TW)

( * ) Notice: Subject to any disclaimer, the term of this patent is extended or adjusted under 35 U.S.C. 154(b) by 255 days.

(21) Appl. No.: 18/463,303

(22) Filed: Sep. 8, 2023

(65) Prior Publication Data

US 2025/0027726 A1 Jan. 23, 2025

(30) Foreign Application Priority Data

Jul. 20, 2023 (TW) ..... 112127034

(51) Int. Cl.
*F28D 15/04* (2006.01)

(52) U.S. Cl.
CPC ..... *F28D 15/043* (2013.01)

(58) Field of Classification Search
CPC ... F28D 15/043; F28D 15/0266; F28D 15/046
See application file for complete search history.

(56) References Cited

U.S. PATENT DOCUMENTS 3,543,839 A * 12/1970 Shlosinger ..... F28D 15/0266 165/274
4,365,664 A * 12/1982 Basiulis ..... F28D 15/043 165/300
4,883,116 A * 11/1989 Seidenberg ..... F28D 15/043 165/41
4,903,761 A * 2/1990 Cima ..... F28D 15/043 165/41
5,839,290 A * 11/1998 Nazeri ..... F28D 15/046 62/119
5,842,513 A * 12/1998 Maciaszek ..... F28D 15/043 165/42
6,058,711 A * 5/2000 Maciaszek ..... F28D 15/043 62/515

(Continued)

FOREIGN PATENT DOCUMENTS

| | | |
|---|---|---|
| CN | 101929816 | 12/2010 |
| CN | 113959244 | 1/2022 |
| TW | 201043901 | 12/2010 |

*Primary Examiner* — Travis Ruby
(74) *Attorney, Agent, or Firm* — JCIPRNET

(57) ABSTRACT

A loop type heat dissipation structure includes a heat pipe, a communicating pipe, and working fluid. The heat pipe includes a pipeline, a capillary structure, and a first barrier body. The pipeline has a first evaporation section, a first condensation section, an outlet, and an inlet. The outlet is located at an edge of the first evaporation section, and the inlet is located at an edge of the first condensation section. The capillary structure is distributed on an inner wall surface of the pipeline and extends from the first condensation section to the first evaporation section. The first barrier body is disposed in the first condensation section and is connected to the capillary structure. One end of the communicating pipe is communicated with the outlet, and the other end of the communicating pipe is communicated with the inlet. The working fluid flows in the heat pipe and the communicating pipe.

11 Claims, 6 Drawing Sheets

(56) References Cited

U.S. PATENT DOCUMENTS

| | | | | |
|---|---|---|---|---|
| 6,571,863 | B1 * | 6/2003 | Liu | F28D 15/043 174/15.2 |
| 7,748,436 | B1 * | 7/2010 | Anderson | F28D 15/0266 165/104.21 |
| 9,261,309 | B2 * | 2/2016 | Wang | F28D 15/0266 |
| 9,599,408 | B1 * | 3/2017 | Hartenstine | F28D 15/046 |
| 2006/0164809 | A1 * | 7/2006 | Yu | H01L 23/467 257/E23.099 |
| 2008/0078530 | A1 * | 4/2008 | Chang | F28D 15/043 165/104.21 |
| 2010/0101762 | A1 * | 4/2010 | Kroliczek | F28D 15/043 165/104.26 |
| 2010/0155019 | A1 * | 6/2010 | Zhou | F28F 1/24 165/104.26 |
| 2010/0263836 | A1 * | 10/2010 | Figus | F28D 15/043 165/104.26 |
| 2010/0307721 | A1 * | 12/2010 | Wang | F28D 15/043 29/890.032 |
| 2011/0192575 | A1 * | 8/2011 | Figus | F28D 15/043 165/104.26 |
| 2014/0174086 | A1 * | 6/2014 | Kare | F01K 11/02 60/670 |
| 2015/0305199 | A1 * | 10/2015 | Yu | F21V 29/00 165/104.21 |
| 2015/0323261 | A1 * | 11/2015 | Tseng | F28D 15/025 165/104.22 |
| 2019/0331432 | A1 * | 10/2019 | Tseng | B33Y 10/00 |
| 2019/0339021 | A1 * | 11/2019 | Tseng | H01L 23/427 |
| 2021/0025657 | A1 * | 1/2021 | Lin | F28D 15/0275 |
| 2022/0128307 | A1 * | 4/2022 | Chen | F28D 15/043 |
| 2024/0044582 | A1 * | 2/2024 | Mu | F28F 3/12 |

* cited by examiner

LOOP HEAT PIPE WITH BARRIER BODY IN CONDENSATION SECTION

CROSS-REFERENCE TO RELATED APPLICATION

This application claims the priority benefit of Taiwan application serial no. 112127034, filed on Jul. 20, 2023. The entirety of the above-mentioned patent application is hereby incorporated by reference herein and made a part of this specification.

BACKGROUND

Technical Field

The disclosure relates to a heat dissipation structure, and in particular, to a loop type heat dissipation structure.

Description of Related Art

Traditional heat pipes and loop type heat pipes are common heat dissipation structures. Taking the traditional heat pipes as an example, the working fluid absorbs heat in the evaporation section to evaporate from a liquid state to a gaseous state and flows along the first direction to the condensation section. Then, the working fluid releases heat in the condensation section to condense from the gaseous state to the liquid state and flows back to the evaporation section along the second direction opposite to the first direction by capillary force (for example, through a capillary structure on the tube wall). Since the gaseous working fluid and the liquid working fluid flow along two opposite directions in the pipeline, the gaseous working fluid may hinder the return flow of the liquid working fluid, causing the heat dissipation performance to be unable to be significantly improved.

Different from traditional heat pipes, the working fluid in the loop type heat pipe is a one-way flow cycle. The working fluid absorbs heat in the evaporation section to evaporate from a liquid state to a gaseous state and flows along the closed circuit to the condensation section. Then, the working fluid releases heat in the condensation section to condense from the gaseous state to the liquid state, and the liquid working fluid is pushed by the gaseous working fluid to flow from the condensation section to the evaporation section along a closed circuit. However, if the flow rate of the gaseous working fluid is too fast, the effect of exothermic condensation may be affected. On the contrary, if the flow rate of the gaseous working fluid is too slow, the heat dissipation efficiency may be affected, causing the heat dissipation performance to be unable to be significantly improved.

SUMMARY

The disclosure provides a loop type heat dissipation structure, which includes a heat pipe, a communicating pipe, and working fluid. The heat pipe includes a pipeline, a capillary structure, and a first barrier body. The pipeline has a first evaporation section, a first condensation section, an outlet, and an inlet. The outlet is located at an edge of the first evaporation section, and the inlet is located at an edge of the first condensation section. The capillary structure is distributed on an inner wall surface of the pipeline and extends from the first condensation section to the first evaporation section. The first barrier body is disposed in the first condensation section and is connected to the capillary structure. One end of the communicating pipe is communicated with the outlet, and the other end of the communicating pipe is communicated with the inlet. The working fluid flows in the heat pipe and the communicating pipe. The working fluid evaporates from a liquid state to a gaseous state in the first evaporation section and flows to the first condensation section along the pipeline and the communicating pipe respectively. The working fluid condenses from the gaseous state to the liquid state in the first condensation section and flows along the pipeline to the first evaporation section through the capillary structure.

Based on the above, the gaseous working fluid may be divided in the first evaporation section so as to reduce the flow rate of the first gaseous working fluid flowing along the pipeline to the first condensation section and reduce the backflow resistance of the liquid working fluid in the pipeline, thereby helping to improve the heat dissipation performance.

DESCRIPTION OF THE EMBODIMENTS

Figure 1:
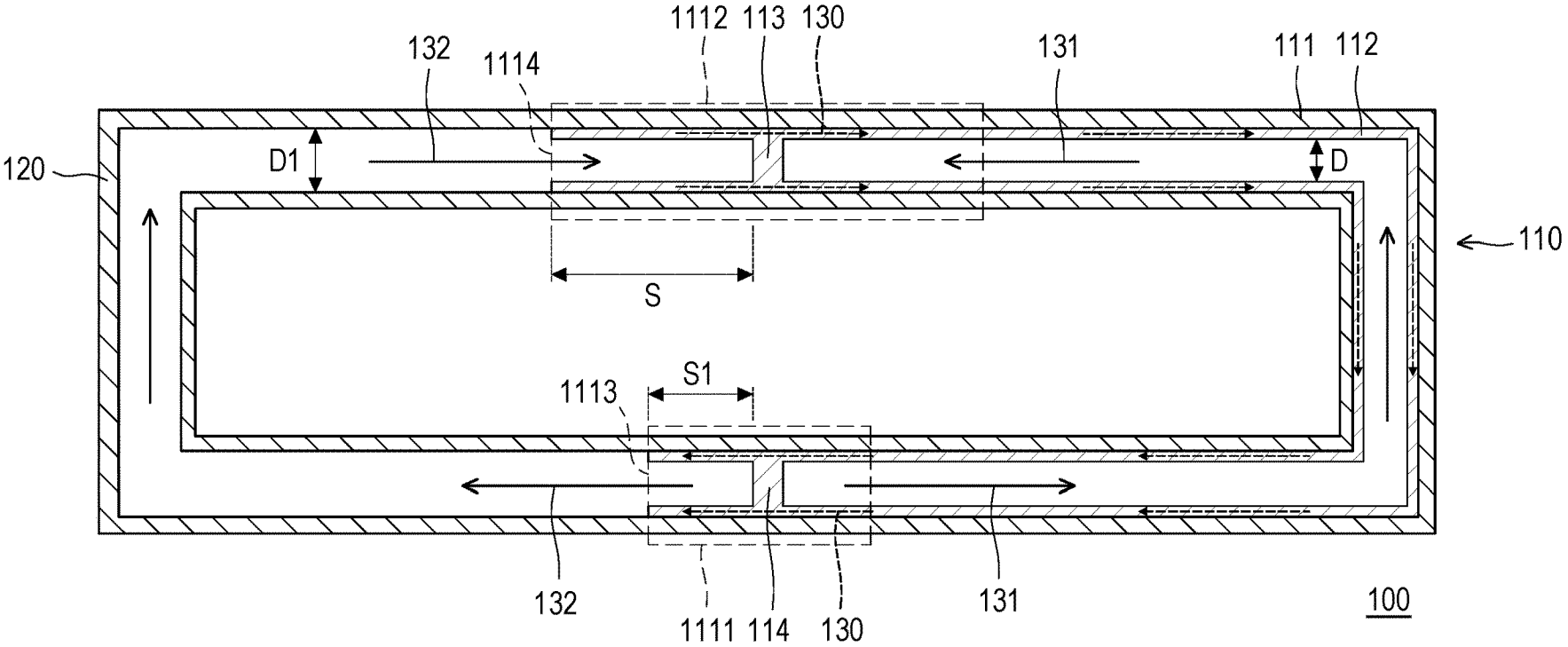
FIG. 1 is a schematic cross-sectional view of a loop type heat dissipation structure according to a first embodiment of the disclosure.

FIG. 1 is a schematic cross-sectional view of a loop type heat dissipation structure according to a first embodiment of the disclosure. Please refer to FIG. 1. In the embodiment, a loop type heat dissipation structure 100 may be applied to a notebook computer or other electronic devices and includes a heat pipe 110, a communicating pipe 120, and working fluid. The heat pipe 110 is communicated with the communicating pipe 120 to form a heat dissipation circuit for the working fluid to flow in the heat dissipation circuit.

In detail, the heat pipe 110 includes a pipeline 111, a capillary structure 112, and a first barrier body 113, and the pipeline 111 has a first evaporation section 1111, a first condensation section 1112, an outlet 1113, and an inlet 1114. The capillary structure 112 is distributed on the inner wall surface of the pipeline 111 and extends from the first condensation section 1112 to the first evaporation section 1111. The first barrier body 113 is disposed in the first condensation section 1112 and is connected to the capillary structure 112.

In the embodiment, the outlet 1113 is located at the edge of the first evaporation section 1111, and the inlet 1114 is located at the edge of the first condensation section 1112. Specifically, the capillary structure 112 extends from the outlet 1113 to the inlet 1114 along the inner wall surface of the pipeline 111. On the other hand, one end of the communicating pipe 120 is communicated with the outlet 1113, and the other end of the communicating pipe 120 is communicated with the inlet 1114.

Further, the first evaporation section 1111 is thermally coupled to a heat source to absorb heat from the heat source. A liquid working fluid 130 absorbs the heat and evaporates into a gaseous working fluid in the first evaporation section 1111, and the gaseous working fluid may be divided into a first gaseous working fluid 131 and a second gaseous working fluid 132. The first gaseous working fluid 131 may flow from the first evaporation section 1111 to the first condensation section 1112 along the pipeline 111, and the second gaseous working fluid 132 may flow out of the first evaporation section 1111 from the outlet 1113 and flow along the communicating pipe 120 toward the inlet 1114 so as to flow into the first condensation section 1112 through the inlet 1114.

As shown in FIG. 1, the communicating pipe 120 is used as a steam distribution pipeline. The flow direction of the first gaseous working fluid 131 and the flow direction of the second gaseous working fluid 132 are opposite to each other, and eventually both flow into the first condensation section 1112. In detail, a first barrier body 113 may be a capillary body, an alloy material body, or a polymer material body and maintains a distance S from the inlet 1114, for example, as being centrally configured in the first condensation section 1112. Under the barrier of the first barrier body 113, the first gaseous working fluid 131 and the second gaseous working fluid 132 respectively flowing into the first condensation section 1112 along the two different flow directions do not result in confluence.

Further, the first condensation section 1112 may be provided with heat dissipation fins, fans, or a combination thereof, so that the first gaseous working fluid 131 and the second gaseous working fluid 132 release heat and condense into the liquid working fluid 130 in the first condensation section 1112. Then, the capillary structure 112 may guide the liquid working fluid 130 to flow back from the first condensation section 1112 to the first evaporation section 1111 along the pipeline 111. That is to say, the flow direction of the liquid working fluid 130 and the flow direction of the first gaseous working fluid 131 are opposite to each other.

In the embodiment, the gaseous working fluid may be distributed in the first evaporation section 1111 so as to reduce the flow rate of the first gaseous working fluid 131 flowing along the pipeline 111 to the first condensation section 1112 and reduce the backflow resistance of the liquid working fluid 130 in the pipeline 111, thereby helping to improve the heat dissipation performance. In addition, the first gaseous working fluid 131 and the second gaseous working fluid 132 respectively flow into the first condensation section 1112 along the two different flow directions and are concentrated in the first condensation section 1112 so as to release heat and condense into the liquid working fluid 130 for discharging heat quickly, thereby helping to improve the heat dissipation performance.

As shown in FIG. 1, the inner wall surface of the communicating pipe 120 is a smooth surface, which helps to reduce the flow resistance of the second gaseous working fluid 132 in the communicating pipe 120. In addition, since the inner wall surface of the pipeline 111 is provided with a capillary structure 112, an inner diameter D of the pipeline 111 is smaller than an inner diameter D1 of the communicating pipe 120. Correspondingly, the flow rate of the first gaseous working fluid 131 in the pipeline 111 is smaller than the flow rate of the second gaseous working fluid 132 in the communicating pipe 120.

On the other hand, the heat pipe 110 further includes a second barrier body 114. The second barrier body 114 is disposed in the first evaporation section 1111 and is connected to the capillary structure 112. The second barrier body 114 may be a capillary body, an alloy material body, or a polymer material body and maintains a distance S1 from the outlet 1113, for example, as being centrally configured in the first evaporation section 1111. Under the barrier of the second barrier body 114, it may be ensured that the first gaseous working fluid 131 does not flow into the communicating pipe 120 and that the second gaseous working fluid 132 does not flow into the pipeline 111.

Figure 2:
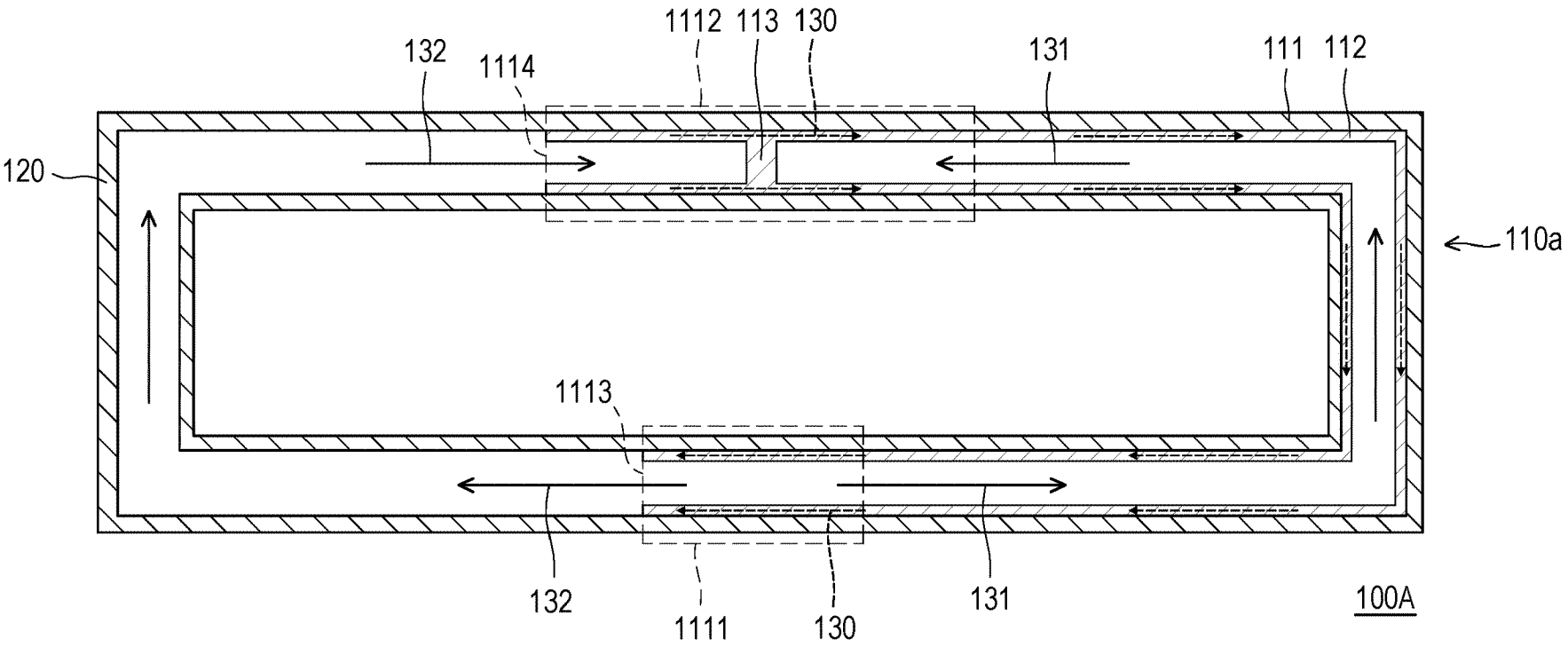
FIG. 2 is a schematic cross-sectional view of a loop type heat dissipation structure according to a second embodiment of the disclosure.

FIG. 2 is a schematic cross-sectional view of a loop type heat dissipation structure according to a second embodiment of the disclosure. Please refer to FIG. 2. The design of a loop type heat dissipation structure 100A of the embodiment is substantially the same as the design of the loop type heat dissipation structure 100 of the first embodiment. The main difference between the two is that a heat pipe 110*a* of the embodiment is not configured with the barrier body in the first evaporation section 1111 so as to automatically distribute the flow rate of the first gaseous working fluid 131 and the second gaseous working fluid 132 through the flow resistance difference inside the pipeline 111 and the communicating pipe 120.

Figure 3:
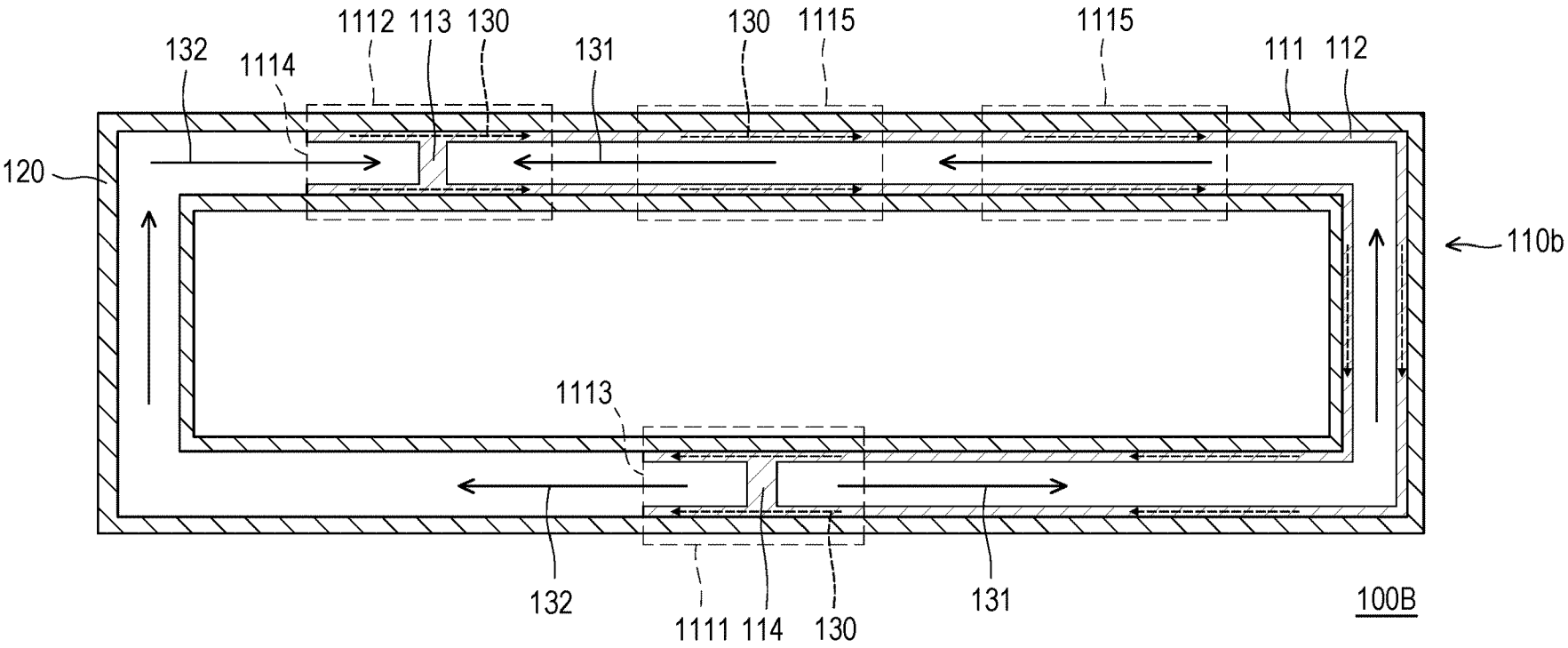
FIG. 3 is a schematic cross-sectional view of a loop type heat dissipation structure according to a third embodiment of the disclosure.

FIG. 3 is a schematic cross-sectional view of a loop type heat dissipation structure according to a third embodiment of the disclosure. Please refer to FIG. 3. The design of a loop type heat dissipation structure 100B of the embodiment is substantially the same as the design of the loop type heat dissipation structure 100 of the first embodiment. The main difference between the two is that a heat pipe 110*b* of the embodiment also has at least one second condensation section 1115 (two are schematically shown) provided between the first evaporation section 1111 and the first condensation section 1112. In detail, the two second condensation sections 1115 are disposed in series with the same side of the first condensation section 1112, and the two second condensation sections 1115 are not configured with the barrier bodies so as to ensure that the first gaseous working fluid 131 may flow and reach the first condensation section 1112. On the other hand, through configuring multiple condensation sections, it helps to improve the heat dissipation efficiency.

In one example, the first condensation section 1112 is configured between the two second condensation sections 1115, but the disclosure is not limited thereto.

Figure 4:
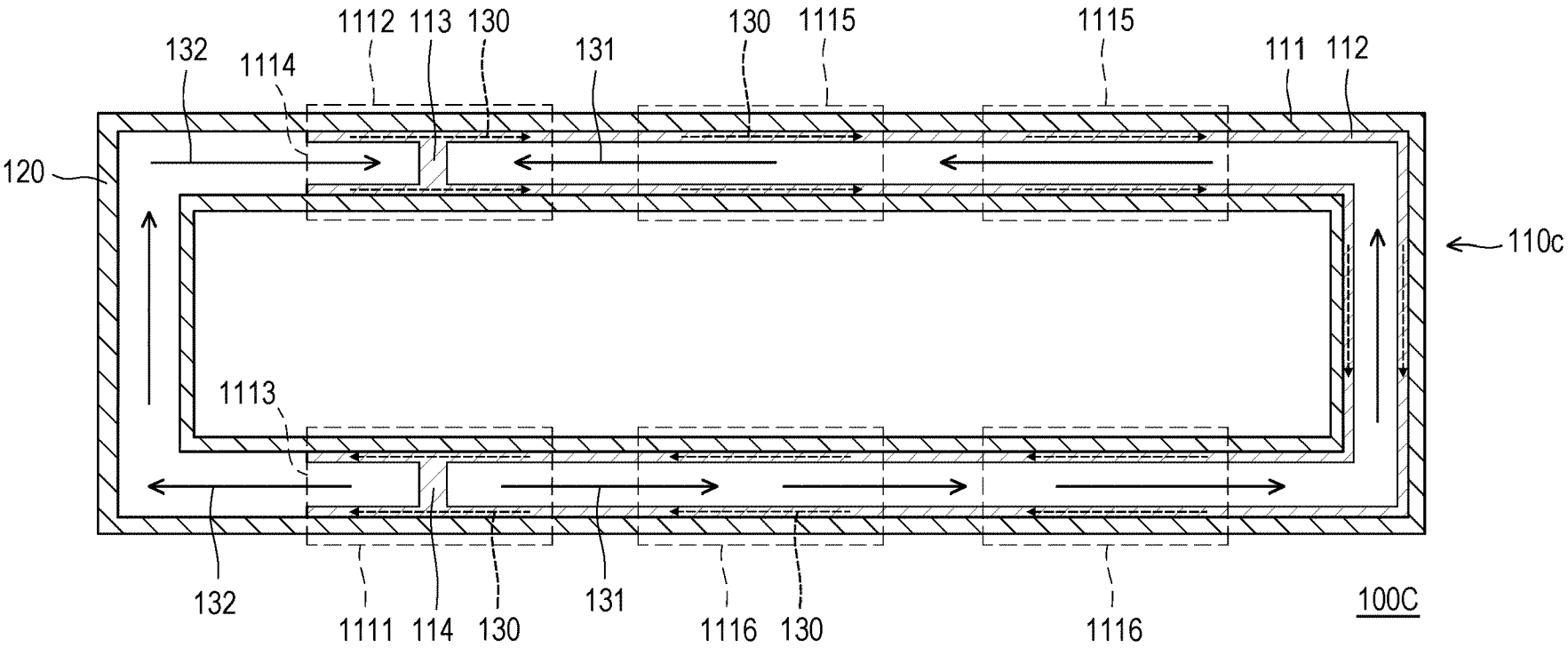
FIG. 4 is a schematic cross-sectional view of a loop type heat dissipation structure according to a fourth embodiment of the disclosure.

FIG. 4 is a schematic cross-sectional view of a loop type heat dissipation structure according to a fourth embodiment of the disclosure. Please refer to FIG. 4. The design of a loop type heat dissipation structure 100C of the embodiment is substantially the same as the design of the loop type heat dissipation structure 100B of the third embodiment. The main difference between the two is that a heat pipe 110*c* of the embodiment also has at least one second evaporation section 1116 (two are schematically shown) provided between the first evaporation section 1111 and the first condensation section 1112. In detail, the two second evaporation sections 1116 are disposed in series with the first evaporation section 1111, and the two second evaporation sections 1116 are not configured with the barrier bodies so as to ensure that the first gaseous working fluid 131 may flow from the first evaporation section 1111 to the first condensation section 1112 along the pipeline 111.

In one example, the first condensation section 1112 is configured between the two second condensation sections 1115, but the disclosure is not limited thereto.

Figure 5:
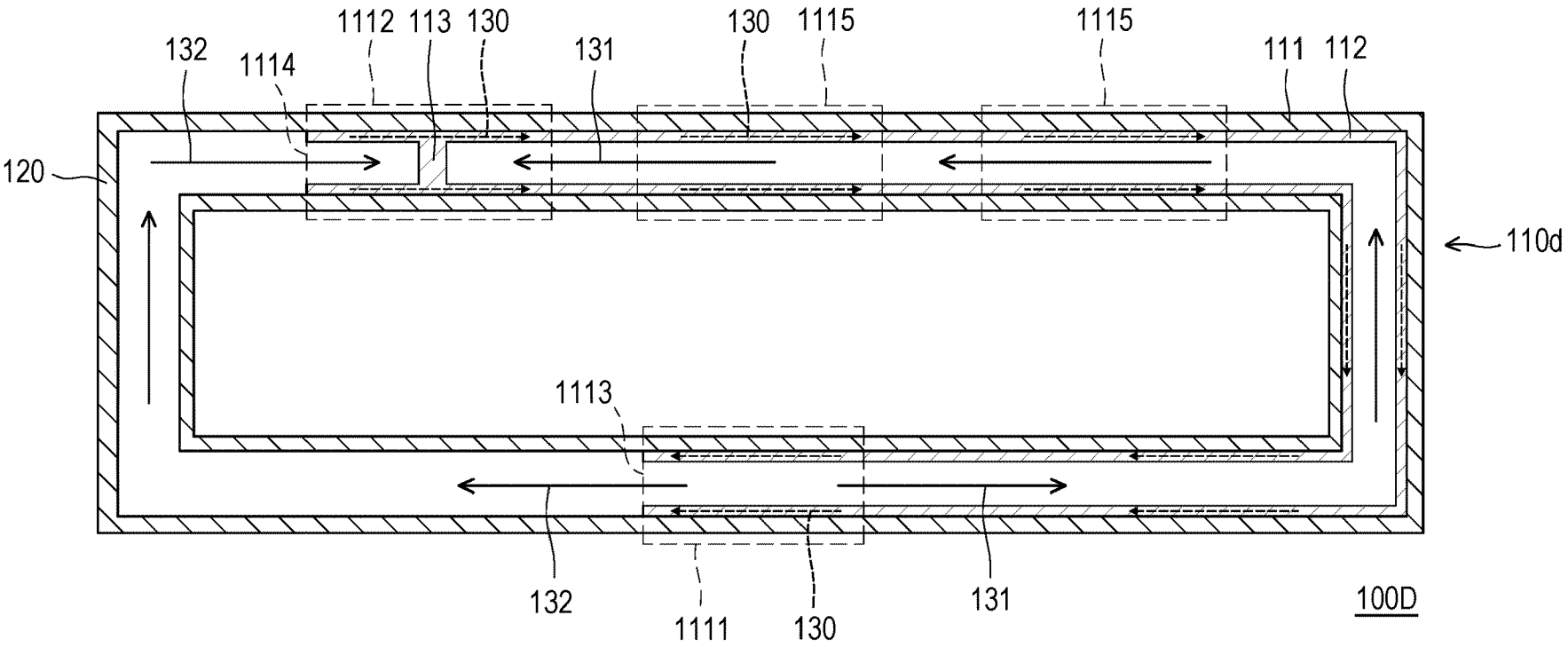
FIG. 5 is a schematic cross-sectional view of a loop type heat dissipation structure according to a fifth embodiment of the disclosure.

FIG. 5 is a schematic cross-sectional view of a loop type heat dissipation structure according to a fifth embodiment of the disclosure. Please refer to FIG. 5. The design of a loop type heat dissipation structure 100D of the embodiment is substantially the same as the design of the loop type heat dissipation structure 100A of the second embodiment. The main difference between the two is that a heat pipe embodiment also has at least one second condensation section 1115 (two are schematically shown) provided between the first evaporation section 1111 and the first condensation section 1112. Specifically, the two second condensation sections 1115 are disposed in series with the first condensation section 1112, and the two second condensation sections 1115 are not configured with the barrier bodies so as to ensure that the first gaseous working fluid 131 may flow and reach the first condensation section 1112. On the other hand, through configuring multiple condensation sections, it helps to improve the heat dissipation efficiency.

In one example, the first condensation section 1112 is configured between the two second condensation sections 1115, but the disclosure is not limited thereto.

Figure 6:
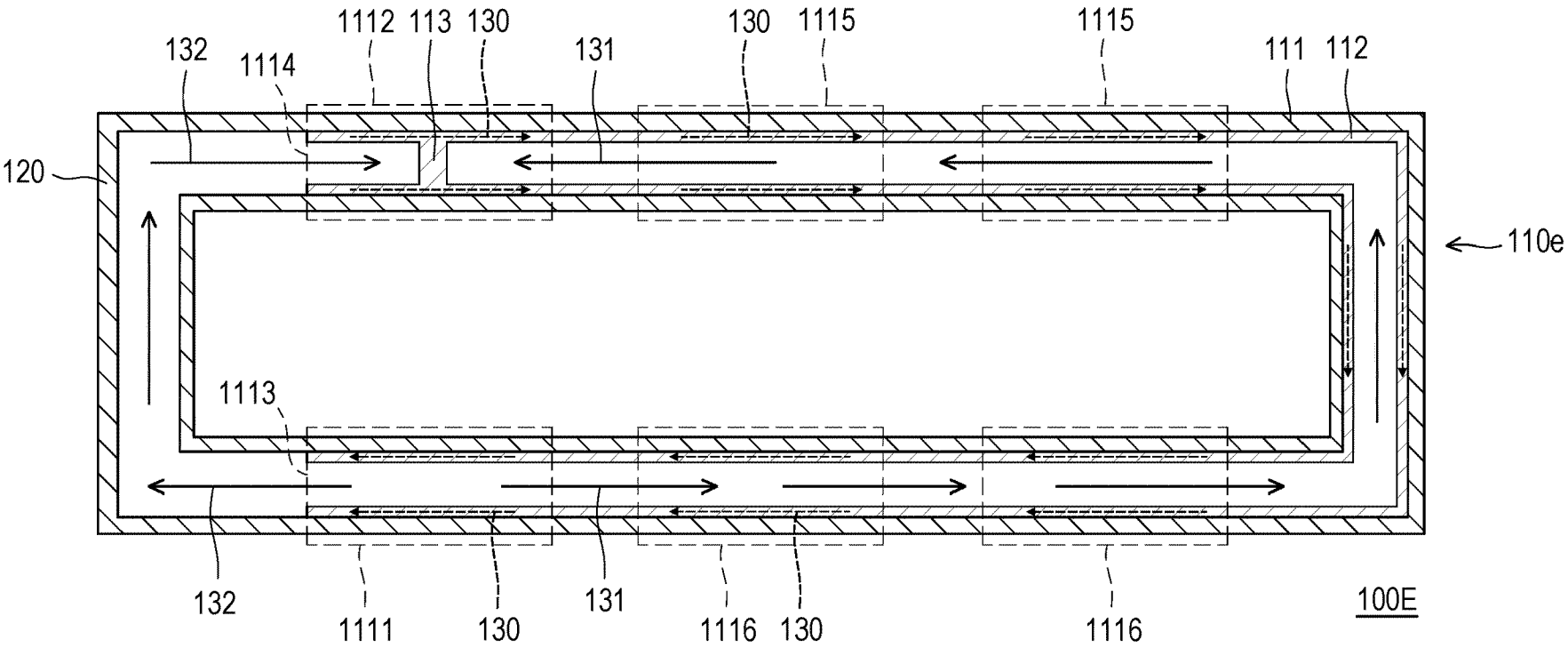
FIG. 6 is a schematic cross-sectional view of a loop type heat dissipation structure according to a sixth embodiment of the disclosure.

FIG. 6 is a schematic cross-sectional view of a loop type heat dissipation structure according to a sixth embodiment of the disclosure. Please refer to FIG. 6. The design of a loop type heat dissipation structure 100E of the embodiment is substantially the same as the design of the loop type heat dissipation structure 100C of the fourth embodiment. The main difference between the two is that the heat pipe 110*d* of the embodiment is not configured with the barrier body in the first evaporation section 1111 so as to automatically distribute the flow rate of the first gaseous working fluid 131 and the second gaseous working fluid 132 through the flow resistance difference inside the pipeline 111 and the communicating pipe 120.

In one example, the first condensation section 1112 is configured between the two second condensation sections 1115, but the disclosure is not limited thereto.

To sum up, the gaseous working fluid may be divided in the first evaporation section so as to reduce the flow rate of the first gaseous working fluid flowing along the pipeline to the first condensation section and reduce the backflow resistance of the liquid working fluid in the pipeline, thereby helping to improve the heat dissipation performance. In addition, the first gaseous working fluid and the second gaseous working fluid respectively flow into the first condensation section along the two different flow directions and are concentrated in the first condensation section to release heat and condense into the liquid working fluid for discharging heat quickly, thereby helping to improve the heat dissipation performance.

Although the disclosure has been described with reference to the embodiments above, the embodiments are not intended to limit the disclosure. Any person skilled in the art can make some changes and modifications without departing from the spirit and scope of the disclosure. Therefore, the scope of the disclosure shall be defined in the appended claims.

What is claimed is:

1. A loop type heat dissipation structure, comprising:

a heat pipe, comprising:

a pipeline, having a first evaporation section, a first condensation section, an outlet, and an inlet, wherein the outlet is located at an edge of the first evaporation section, and the inlet is located at an edge of the first condensation section;

a capillary structure, distributed on an inner wall surface of the pipeline and extending from the first condensation section to the first evaporation section; and a first barrier body, disposed in the first condensation section, and connected to the capillary structure, wherein the capillary structure located in the first condensation section further extends from the first barrier body to the inlet; and a communicating pipe, wherein an end of the communicating pipe is communicated with the outlet, and another end of the communicating pipe is communicated with the inlet; and a working fluid, flowing in the heat pipe and the communicating pipe, wherein the working fluid evaporates from a liquid state to a gaseous state in the first evaporation section, thereby forming a first gaseous working fluid that flows in a first flow direction and a second gaseous working fluid that flows in a second flow direction opposite to the first flow direction, and the working fluid condenses from the gaseous state to the liquid state in the first condensation section and flows to the first evaporation section along the pipeline through the capillary structure.

2. The loop type heat dissipation structure according to claim 1, wherein the heat pipe further comprises:

a second barrier body, disposed in the first evaporation section, and connected to the capillary structure, wherein the capillary structure located in the first evaporation section further extends from the second barrier body to the outlet.

3. The loop type heat dissipation structure according to claim 2, wherein a distance is maintained between the second barrier body and the outlet.

4. The loop type heat dissipation structure according to claim 2, wherein the second barrier body comprises a capillary body, an alloy material body, or a polymer material body.

5. The loop type heat dissipation structure according to claim 1, wherein a distance is maintained between the first barrier body and the inlet.

6. The loop type heat dissipation structure according to claim 1, wherein the first barrier body comprises a capillary body, an alloy material body, or a polymer material body.

7. The loop type heat dissipation structure according to claim 1, wherein a flow rate of the working fluid in the gaseous state in the pipeline is smaller than a flow rate of the working fluid in the gaseous state in the communicating pipe.

8. The loop type heat dissipation structure according to claim 1, wherein an inner diameter of the pipeline is smaller than an inner diameter of the communicating pipe.

9. The loop type heat dissipation structure according to claim 1, wherein an inner wall surface of the communicating pipe is a smooth surface.

10. The loop type heat dissipation structure according to claim 1, wherein the pipeline further has at least one second condensation section disposed in series with the first condensation section, and the second condensation section is located between the first condensation section and the first evaporation section.

11. The loop type heat dissipation structure as according to claim 1, wherein the pipeline further has at least one second evaporation section disposed in series with the first evaporation section, and the second evaporation section is located between the first evaporation section and the first condensation section.

* * * * *